US012766392B2

(12) United States Patent
Lay et al.

(10) Patent No.: US 12,766,392 B2
(45) Date of Patent: Oct. 20, 2026

(54) DUAL-PURPOSE PITCHING AND PITCHBACK MACHINE WITH SHOCK-ABSORBING NETTING AND BALL-CHUTE HARNESS

(71) Applicant: World Sports Products, Inc., St. George, UT (US)

(72) Inventors: William Coleman Lay, St. George, UT (US); Joseph Coleman Lay, St. George, UT (US)

(73) Assignee: World Sports Products, Inc., St. George, UT (US)

( * ) Notice: Subject to any disclaimer, the term of this patent is extended or adjusted under 35 U.S.C. 154(b) by 340 days.

(21) Appl. No.: 18/614,606

(22) Filed: Mar. 22, 2024

(65) Prior Publication Data

US 2025/0295971 A1 Sep. 25, 2025

(51) Int. Cl.

| | |
|---|---|
| ***A63B 69/00*** | (2006.01) |
| ***A63B 69/40*** | (2006.01) |
| ***A63B 71/02*** | (2006.01) |
| *A63B 47/02* | (2006.01) |

(52) U.S. Cl.

CPC ..... *A63B 69/0002* (2013.01); *A63B 69/40* (2013.01); *A63B 71/022* (2013.01); *A63B 71/023* (2013.01); *A63B 47/025* (2013.01); *A63B 2069/0006* (2013.01); *A63B 2069/0008* (2013.01); *A63B 2069/0011* (2013.01)

(58) Field of Classification Search

CPC ... A63B 69/0002; A63B 69/40; A63B 47/025; A63B 71/022; A63B 71/023

USPC ..... 473/432

See application file for complete search history.

(56) References Cited

U.S. PATENT DOCUMENTS

| | | | | |
|---|---|---|---|---|
| 4,836,542 | A * | 6/1989 | Crawley | A63B 63/008 273/400 |
| 4,883,272 | A * | 11/1989 | Lay | A63B 63/00 473/436 |
| 5,417,196 | A * | 5/1995 | Morrison | A63B 69/40 124/6 |
| 9,011,278 | B2 * | 4/2015 | Lay | A63B 71/022 473/422 |
| 12,194,361 | B2 * | 1/2025 | Banjo | A63B 69/407 |
| 12,390,713 | B1 * | 8/2025 | Joseph | A63B 71/0605 |

* cited by examiner

*Primary Examiner* — Mitra Aryanpour
(74) *Attorney, Agent, or Firm* — Madson IP, P.C.

(57) ABSTRACT

A ball propelling apparatus is interchangeable between pitching mode and a pitch back mode. In the pitching mode, a ball propelling machine with a mounting assembly is supported by a support assembly at a height above a supporting surface. The support assembly connects to the mounting assembly. In the pitch back mode, a netting structure having a framework assembly and a ball-chute harness is provided and the framework assembly is connected to the mounting assembly while the ball-chute harness for connecting to the ball propelling machine. The framework assembly has a base assembly that is positioned to contact the supporting surface while supporting a net anchoring assembly to which netting is secured to capture and funnel thrown balls into the ball-chute harness. The balls that are funneled into the ball propelling machine by the ball-chute harness are pitched back toward the thrower.

15 Claims, 8 Drawing Sheets

DUAL-PURPOSE PITCHING AND PITCHBACK MACHINE WITH SHOCK-ABSORBING NETTING AND BALL-CHUTE HARNESS

BACKGROUND OF THE INVENTION

1. Field of the Invention

The present invention relates to combination pitching and pitchback machines, and more particularly, to a ball propelling machine that may be configured in a pitching mode by placing the machine on a support assembly and may be configured in a pitchback mode by attaching it to a shock-absorbing net structure and a ball-chute harness. Additionally, the present disclosure relates generally to the field of recreational equipment, and more specifically, to sports training equipment.

2. The Relevant Technology

In many sporting events players participate by pitching, hitting, catching, and/or fielding balls. During training, such players may practice wherever there is adequate space, within specialized enclosures such as batting cages, bullpen enclosures, and the like that are enclosed by netting or in less confined space such as the player's back yard, an empty lot, on a practice field, court, or in a ballpark. Whether the practicing activity is done individually, in a small group, or as a team, ball throwing or swing practice is essential to skills development. Numerous skills development aids have been developed and marketed over the years.

Skills development aids need to work easily and efficiently with minimum non-development energy expended in set up and operation so that enthusiastic training is fostered and maintained, and the player's time spent training is efficient and effective.

Accordingly, a need exists for a combination pitching and pitchback machine that is easily interchangeable between a pitching mode and a pitchback mode where the set up and operation is easy and efficient, minimizing non-development energy and time spent, and the actual practice time is maximized.

Further, a need exists for a combination pitching and pitchback machine wherein operation of the device in the pitching mode and in the pitchback mode fosters enthusiastic training, and the device provides reliable efficiency and effectiveness so that player's time spent practicing is enjoyable and effective in developing the player's skills. Specifically, these needs are addressed by a new pitching/pitchback machine disclosed herein.

BRIEF SUMMARY OF THE INVENTION

The present invention has been developed in response to the present state of the art, and in response to the problems and needs in the art that have not yet been fully solved and is not currently available. The present invention provides a new combination pitching/pitchback machine having a pitching mode for batting, catching, and fielding practice, and a pitchback mode for pitching, throwing, catching, and fielding practice.

The combination pitching/pitchback machine of the present invention is a ball propelling machine having a mounting assembly, a support assembly having a connection assembly for connecting to the mounting assembly, and a netting structure has a framework assembly and a ball-chute harness wherein the framework assembly has a connecting assembly connectable to the mounting assembly and the ball-chute harness connects to the ball propelling machine.

The combination pitching/pitchback machine is in the pitching mode when the support assembly's connection assembly is connected to the mounting assembly of the ball propelling machine and the ball propelling machine is supported by the support assembly at a height above the supporting surface for pitching balls or throwing grounders, pop-ups, or fly balls. The combination pitching/pitchback machine is in the pitchback mode when the connection assembly is disengaged from the mounting assembly and the connecting assembly of the framework assembly is connected to the mounting assembly, and the ball-chute harness is connected to the ball propelling machine.

In some embodiments, the ball propelling machine has a handle and the combination pitching/pitchback machine may have a third mode, a transporting mode. The ball propelling apparatus is in the transporting mode when the mounting assembly is disengaged from both the connection assembly of the support assembly and the connecting assembly of the framework assembly. In the transporting mode, the handle may be grasped to carry the ball propelling machine from one location to another location. Furthermore, the ball propelling machine may be used in a freestyle manner with a user propelling balls while directing the balls to be randomly propelled upward, downward, to one side or the other, to conduct a catching and/or fielding practice combining infield practice and out field practice in a random order and to random players to simulate gameplay where the players do not know where a ball may be hit. Although this may be an effective training practice conducted by an adult user, it is not recommended for a youthful player with limited strength and discipline to conduct such a training session.

In a further embodiment, the ball propelling machine, while in the pitching mode may be used to pitch batting practice and the netting structure and ball-chute harness is positioned sufficiently behind the batter. With this embodiment, balls pitched by the ball propelling machine that are not hit or some foul tips may be captured in the netting secured to the netting structure, acting as a backstop, and funneled to the ball-chute harness to roll out harmlessly forward of the netting structure.

In some embodiments of the combination pitching/pitchback machine while configured in the pitching mode, the supporting assembly may be a tripod or have a weighted base. If a tripod, the tripod may have legs and a center column with a head. If a weighted base, the weighted base will also have a center column with the head. Connecting the tripod fixedly to the ball propelling machine may be a pivot adjustment assembly to facilitate tilt rotation about a pivot axis. For optimum stability, the pivot axis perpendicularly intersects the central longitudinal axis of a vertically disposed center column. Although optimum stability is not always necessary for the ball propelling machine to operate acceptably, the closer the center column is disposed to vertical, the more stable the ball propelling machine will be atop the supporting assembly. The center column may be of a telescoping structure that enables height adjustment. However, that height adjustment feature is just an exemplary embodiment. The center column may be non-telescoping, non-height adjustable, or height adjustable without being telescoping.

In exemplary embodiments of the combination pitching/pitchback machine while configured in the pitchback mode, the framework assembly has a base assembly and a net anchoring assembly, the base assembly may be positioned to rest on the supporting surface (such as the ground, a concrete pad, etc.) while supporting the connected net anchoring assembly above the supporting surface.

An exemplary embodiment of the base assembly may provide 4-point stability and support for the netting structure, making the netting structure with netting secured thereon tilt-adverse, wind resistant, and not as susceptible to a teeter-tottering situation. The base assembly may be configured in many different configurations without departing from the spirit and scope of the present invention. An exemplary base assembly has a cross bar with a first end and a second end disposed at opposite ends of the cross bar, a first transverse foot, a second transverse foot, a first upturned pole receptacle, and a second upturned pole receptacle. The transverse feet may be disposed transverse to the cross bar (meaning disposed across the cross bar, including angled or orthogonally) with each connecting to the cross bar proximate to one of the opposing ends (first end and second end).

The first transverse foot may have a first upturned heal portion and a first toe portion and the second transverse foot may have a second upturned heal portion and a second toe portion, and each upturned heal portion may have a pole receiving end.

The transverse feet are instrumental in creating anti-teeter-tottering situation because, in some embodiments the interplay in the connection of the transverse feet to the cross bar determines if the cross bar is supported above the supporting surface (i.e., the underside of the cross bar is disposed above the supporting surface). This small elevation of the cross bar avoids most situations where an uneven supporting surface may have high points that may become a fulcrum that turns the cross bar into a teeter-totter.

In some exemplary embodiments, the upturned heal portions and the toe portions of each transverse foot are configured so that each will contact the supporting surface when positioned to rest upon a flat supporting surface and that an underside of the cross bar is disposed above the supporting surface. One such configuration, for example, has the transverse feet subtending the cross bar where they connect with the cross bar and the transverse feet are flat heal to toe. Another exemplary configuration has the first transverse foot inclined from the first upturned heal portion to the cross bar and also inclined from the first toe portion to the cross bar, thereby forming an arch portion of the first transverse foot and has the second transverse foot likewise inclined from the second upturned heal portion to the cross bar and the second toe portion likewise inclined to the cross bar, thereby forming a corresponding arch portion of the second transverse foot. With this configuration placed on a flat supporting surface only the upturned heal portions and the toe portions contact the flat supporting surface because the arch portions will be spaced from the flat supporting surface. Consequently, it is less likely that any high points in an uneven supporting surface will become a fulcrum to turn the transverse feet into a teeter-totter, and if there is such a high point fulcrum, slight shifting of the base assembly forward, back or from one side to another will avoid instability creating a 4-point stability for the base assembly.

In the pitchback mode, the base assembly further comprises a mounting pedestal upon which the ball propelling machine is mounted by securing the mounting pedestal to the mounting assembly. To center the ball propelling machine, which may have a vertical tilting range upward and downward from horizontal, to propel balls along the vertical center of the framework, the mounting pedestal is offset from the center of the framework. With the ball propelling machine secured to the mounting pedestal, the launch point of the propelled balls will be above the cross bar that may already be elevated above the supporting surface, the height of that launch point elevation will determine the practical limit for tilting the ball propelling machine from propelling grounders, high hop grounders, worm burners (hard hit grounders that skid along close to the ground). Without tilting the ball propelling machine upward that launch point is low enough that propelled ball will likely bounce before it reaches the player throwing the ball into the netting. Hence, in most pitchback instances the ball propelling machine will be tilted upward so that the ball is returned to the thrower within the reasonable catch radius without causing the thrower to move or jump, or to have the pitchback to simulate a line drive, a blooper, a pop-up, or a fly ball. For this reason, it is preferred that the ball propelling machine have vertical tilting capability, though is not absolutely required, because the mounting pedestal may be angled to provide upward ball trajectory that returns the ball to the thrower at a standard reasonable catch radius, thereby compensating for a ball propelling machine that launches the ball horizontally while in the pitching mode.

Further, the base assembly, in some exemplary embodiments, may be modular in that the cross bar may comprise two or more cross bar sections that may be secured to each other to form the cross bar. If there are only two equal length cross bar sections, the mounting pedestal will be connected to just one section offset from the joint connection of the two cross bar sections. Additionally, the transverse feet may also be modular, divided into feet sections. Such modularity typically is advantageous to packaging and shipping.

The base assembly has a low profile (again advantageous for packaging and shipping) that supports the net anchoring assembly above the supporting surface. The net anchoring assembly includes a plurality of poles that may be assembled to provide the structure for attaching a netting and maintain the contours and shape designed into the netting. The plurality of poles includes foundation poles and extension poles. The foundation poles and the extension poles may be the same or different, for example, they may be made of the same material or a differing material, have the same diameters or a differing diameter, the same thickness or a differing thickness, the same weight density or a differing weight density, the same flexibility or a differing flexibility, and/or the same resiliency or a differing resiliency. In short, the foundation poles and the extension poles may have the same physical characteristics pertinent to structural poles of this type or different physical characteristics.

In one exemplary embodiment, the foundation poles and/or the extension poles may be made of the same materials and have the same physical characteristics as the base assembly. In another exemplary embodiment, the base assembly may be made of aluminum or a light-weight steel while the foundation poles and/or the extension poles may be made of fiberglass or another fiber-reinforced polymer. Yet another exemplary embodiment may have the foundation poles be thicker, heavier, and/or less flexible and the extension poles be thinner, lighter and/or more flexible. Those skilled in the art armed with this disclosure, will understand the range of flexibility there is in determining what physical characteristics the base assembly, the foundation poles, and the extension poles may exhibit and how they interplay with each other to fine tune resulting effects on the netting structure, the framework assembly, and the pitchback assembly (the netting structure plus a netting assembly as attached).

In some exemplary embodiments, foundation poles will be seated into and rest within the pole receiving ends of the upturned heal portions of the base assembly and the upturned pole receptacles of the base assembly. These foundation poles may be foundational in defining the contours and design of the netting assembly.

As an exemplary embodiment of the netting assembly, the netting assembly may have a netting floor, netting side panels, a netting rear panel, a netting front panel, a shock-absorbing netting flap, peripheral netting edge ribbons, and netting attachment features of various types. The netting floor may have a generally rectangular footprint with netting attachment features secured to each corner and peripheral netting edge ribbons may be threaded with elastic cords. The foundation poles seated within the upturned pole receptacles of the base assembly may each have a pole connecting sleeve with a hook to which a netting attachment feature may be releasably secured. The foundation poles seated within the pole receiving ends of the upturned heal portions of the base assembly (together with the foundation poles seated within the upturned pole receptacles are considered foundational poles and may be referred to herein collectively as first level foundational poles) may have anchoring end caps to which a netting attachment feature may be releasably secured. The netting floor may have a throat opening secured with a tension assembly that is attached or attachable to the ball-chute harness. The tension assembly assists in creating and maintaining a funnel-shaped contour for the netting floor by applying the proper tension between the netting floor peripheral netting edge ribbons and the tension assembly at the throat opening and adding the weight of the ball-chute harness when attached.

The netting side panels, netting rear panel, and netting front panel each have peripheral netting edge ribbons and are connected to the netting floor. Where the netting floor lays generally horizontal directionally, the netting side panels, a netting rear panel, a netting front panel each drape vertical directionally and together they generally form a pouch with the back extending higher than the front.

Either a pair of foundation poles or a pair extension poles may be positioned to extend upward and seated within the pole connecting sleeves with hooks, thereby connecting the pair of foundation poles or the pair extension poles to the pair of foundation poles securing the netting floor and having the pole connecting sleeves with hooks. The selection of whether the pair of foundation poles or the pair extension poles matters only if they differ in physical characteristics that matter to the operation of the structure; for example, and not to be limiting, more heavy duty foundation poles may be desired for professional, college, or high school use and a lighter duty more flexible extension poles may be desired for youth, indoor only use, or mass market sales.

Each pole the of the selected pair of foundation poles or a pair extension poles may have pole connecting sleeves with hooks and may be referred to herein collectively as second level framework poles. The netting assembly has a pair of side/front junctures where the netting front panel connects to the netting side panels and netting attachment features are located. The netting attachment features located at the side/front junctures may be secured to the pole connecting sleeves with hooks to place tension on the upper edge of the netting front panel, thereby assisting in keeping the netting front panel generally vertical and a cup structure to keep thrown balls within the confines of the cup structure and funnel the balls to the throat opening.

One or more pairs of extension poles may be connected, directly or indirectly, to the pole connecting sleeves with hooks of the second level framework poles. These pairs of extension poles determine the height of the netting structure. If only one pair of extension poles is used as in one exemplary embodiment of the pitchback assembly, the length may be limited by packaging and shipping considerations and physical characteristics like strength and flexibility may be considerations. In the exemplary embodiment depicted in the drawings, two pairs of extension poles are shown, the lowermost pair of extension poles may be secured directly to and seated within the pole connecting sleeves with hooks of the second level framework poles. This lowermost pair extension poles may have a pole connection sleeve into which another extension pole may be secured and seated. The uppermost pair of extension poles may have an anchoring end cap and secure directly to the pole connection sleeve. To extend tensioned support for the netting side panels, each netting side panel has a pass-through sleeve connected to the peripheral netting edge ribbon along the forward edge of the netting side panel. The uppermost corners of the netting assembly have netting attachment features that may be attached to the anchoring end caps of the uppermost pairs of extension poles.

These and other features of the present invention will become more fully apparent from the following description or may be learned by the practice of the invention as set forth hereinafter.

BRIEF DESCRIPTION OF THE DRAWINGS

For the above-recited and other features and advantages of the invention to be readily understood, a more particular description of the invention briefly described above will be rendered by reference to specific embodiments thereof which are depicted or illustrated in the appended figures. Understanding that these depictions and drawings show only typical embodiments of the invention and should not be considered limiting of its scope, the invention will be described and explained with additional specificity and detail with reference to the accompanying figures in which:

FIG. 7A depicts the securing of the dual-purpose ball propelling machine to the ball-chute harness non-rigidly by using a spring with one hook end connected to the ball-chute harness, while FIG. 7B depicts the spring looping around a handle of the dual-purpose ball propelling machine and both hook ends connected to the ball-chute harness, capturing the ball-chute harness in a somewhat resilient connection, allowing some movement but not detachment. FIG. 7C is a rearward perspective view of the ball-chute harness positioned and connected to the dual-purpose ball propelling machine, while FIG. 7D is a top view of the ball-chute harness positioned and connected to the dual-purpose ball propelling machine. FIG. 7E is a perspective view of an exemplary staging of the ball-chute harness as connected to the dual-purpose ball propelling machine staged for connection to an exemplary embodiment of a netting harness that defines a throat opening of the netting assembly to the ball-chute harness.

Figures 1A, 1B, 1C:
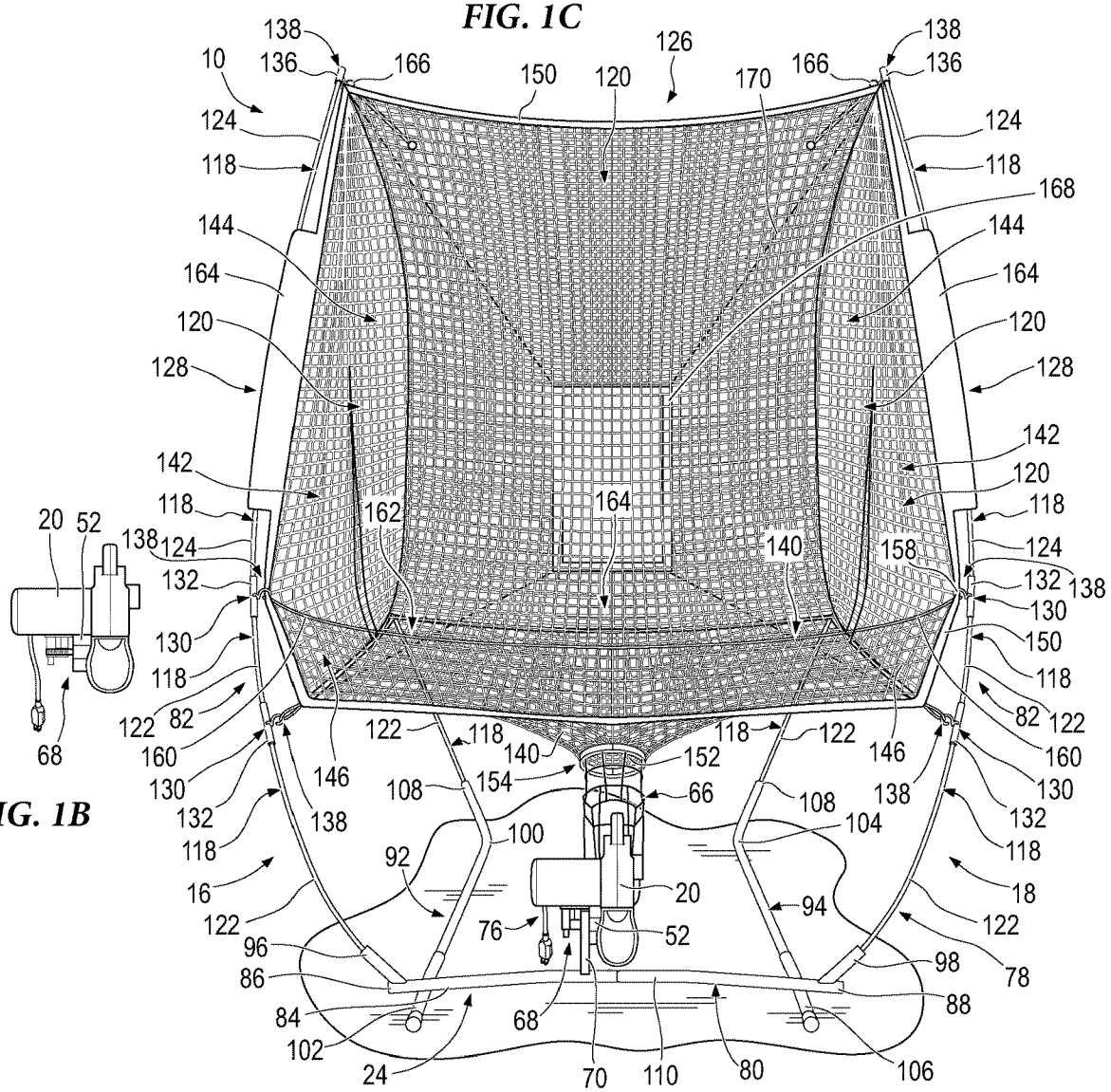
FIGS. 1A, 1B, and 1C are a sequence of perspective views of exemplary embodiments of a dual-purpose ball propelling machine in a pitching mode while supported on a support assembly (FIG. 1A), in transition between modes (FIG. 1B), and in a pitchback mode while connected to a netting structure (FIG. 1C).

REFERENCE NUMBERS dual-purpose ball propelling machine (combination pitching/pitchback machine) 10
pitching mode 12
support assembly 14
pitchback mode 16
netting structure 18
ball propelling machine 20
balls 22
supporting surface 24
tripod base 28
base mount 30
leg(s) 32
center column 34
head 36
center column receiver 38
leg receiver(s) 40
pivot adjustment assembly 42
elongate recess 44
receiving disk 46
ceiling wall 48
parallel side walls 50
anchoring transverse column 52
threaded pivot axis bolt 54
rotatable handle 56
head bore 58
first meshing teeth interface 60
second meshing teeth interface 62
resilient compression pad 64
ball-chute harness 66
mounting assembly 68
mounting pedestal 70
pedestal bore 72
connection assembly 74
connecting assembly 76
framework assembly 78
base assembly 80
net anchoring assembly 82
cross bar 84
first end 86
second end 88
first transverse foot 92
second transverse foot 94
first upturned pole receptacle 96
second upturned pole receptacle 98
first upturned heal portion 100
first toe portion 102
second upturned heal portion 104
second toe portion 106
pole receiving end 108
underside 110
arch portion 112
cross bar section(s) 114
feet section(s) 116
pole(s) 118
netting assembly 128
netting 120
foundation poles 122
extension poles 124
pitchback assembly 126
pole connection features 130
pole connecting sleeve(s) 132
hook(s) 134
anchoring end cap(s) 136
netting attachment feature(s) 138
netting floor 140
netting side panel(s) 142
netting rear panel 144
netting front panel 146
shock-absorbing netting flap 148
peripheral netting edge ribbon(s) 150
throat opening 152
tension assembly 154
pouch 156
side/front juncture(s) 158
upper edge 160
cupping structure 162
pass-through sleeve 164
uppermost corner(s) 166
target square 168
target square straps 170
spring 172
ball hook end(s) 174
handle 176
netting harness 178
elastic cords 180
backside sliding connection 181
T-flange 182
slot structure 184
parallel harness bars 186
ball chute 188
loop tab 190 ring anchors 192
netting flap inhibitor 194
anti-snag balls 196
looped cord 198
circular groove 200
pivot axis A
dashed line B

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

The invention of the present disclosure is quite versatile, operating in different modes and different possible configurations, making pitching for batting practice and/or fielding and catching practice, transporting, and pitchback for one-person catch, pitching practice, throwing followed by fielding and catching practice interest holding, easy and efficient having the ability to mix and match simulations of gameplay situations. Obviously, every different situation should not be described in this disclosure when a representative example will sufficiently teach the invention and how it is used for not only the representative example but for many other uses that will be readily apparent to those of ordinary skill in the art who have been informed and taught by this disclosure. Consequently, for the sake of brevity and without compromising or limiting the teachings herein, the invention of this disclosure will be described in reference to exemplary, representative situations. Thus, the following detailed description of the embodiments of the representative examples of the present invention, as depicted in the figures, is not intended to limit the scope of the invention, as claimed, but is merely representative of one of many presently preferred embodiments of the invention.

FIGS. 1A, 1B, and 1C are a sequence of perspective views of exemplary embodiments of a dual-purpose ball propelling machine (referred herein sometimes as a "combination pitching/pitchback machine 10") in mode configurations transitioning from a pitching mode 12 while supported on a support assembly 14 as depicted in FIG. 1A, in transition between modes as depicted in FIG. 1B, and in a pitchback mode 16 while connected to a netting structure 18 as depicted in FIG. 1C. The pitching mode 12, as depicted in FIG. 1A, schematically shows a ball propelling machine 20 propelling balls 22 while being supported elevated above a supporting surface 24 (such as the ground, a pitching mound, concrete, a platform, etc.) by a support assembly 14.

The support assembly 14 may be of any suitable type. As depicted, the support assembly 14 comprises a tripod base 28 having a base mount 30 and legs 32, and a center column 34 having a head 36 as the uppermost portion of the center column 34. The tripod base 28 may be modular (as depicted) or constructed as a unitary piece. The base mount 30 has a center column receiver 38 and leg receivers 40 into which the center column 34 and the legs 32 are seated securely. Connecting the tripod base 28 fixedly to the ball propelling machine 20 is a pivot adjustment assembly 42 that facilitates tilt rotation about a pivot axis A. For optimum stability, the pivot axis A perpendicularly intersects the central longitudinal axis of a vertically disposed center column 34. Although optimum stability is not always necessary for the ball propelling machine 20 to operate acceptably, the closer the center column 34 is disposed to vertical, the more stable the ball propelling machine 20 will be atop the support assembly 14. Although, the center column 34 is depicted as non-telescoping and non-height adjustable, the center column 34 may be of a telescoping structure that enables height adjustment or height adjustable without being telescoping.

Figure 3:
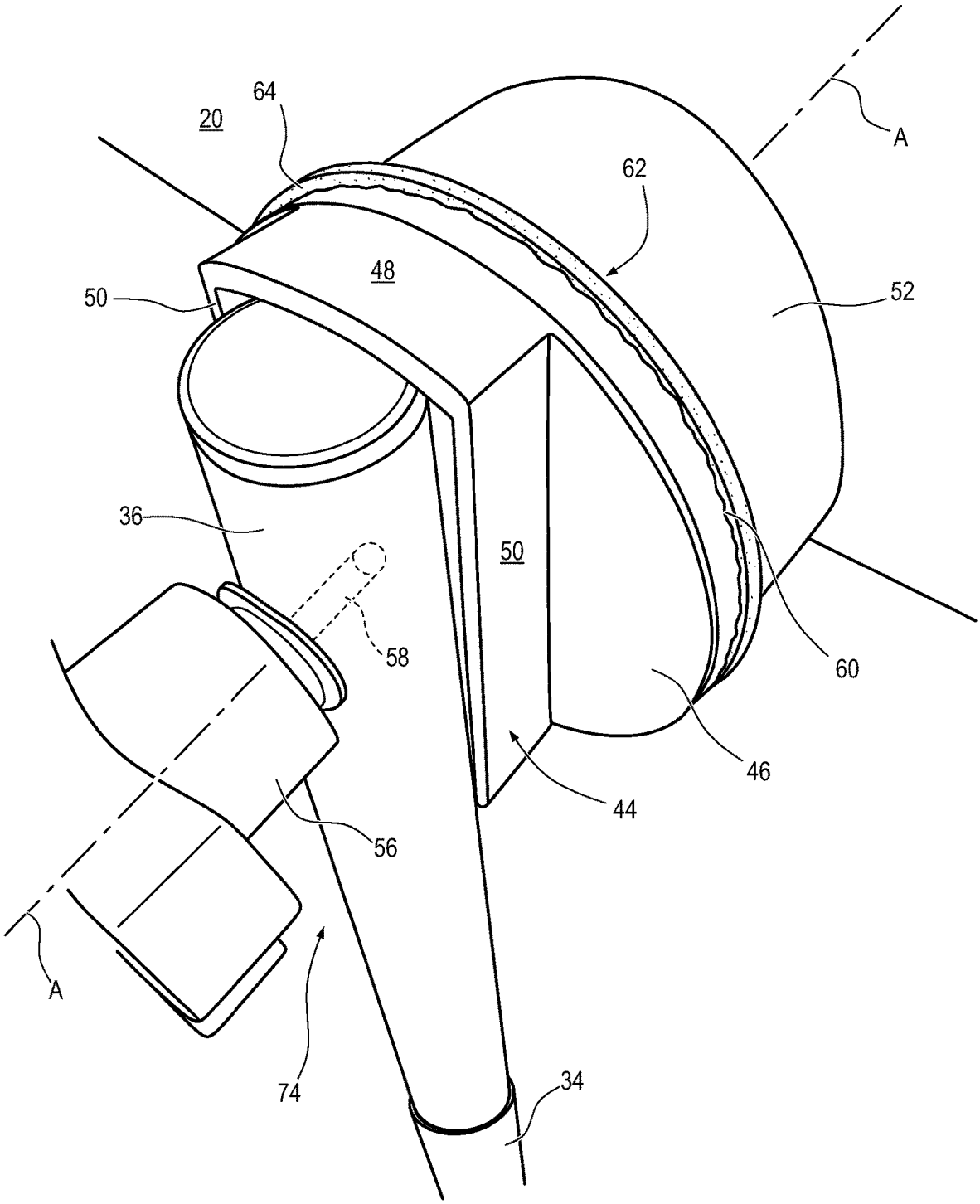
FIG. 3 is an enlarged perspective view of an exemplary pivot adjustment assembly showing the head of the center column nesting within an elongate recess.

The connection of the ball propelling machine 20 to the support assembly 14 is best depicted in FIG. 3 wherein FIG. 3 is an enlarged perspective view of an exemplary pivot adjustment assembly 42 showing the head 36 of the center column 34 nesting within an elongate recess 44. Pivot adjustment assembly 42 comprises a receiving disk 46 with the elongate recess 44 having a ceiling wall 48 and parallel side walls 50, an anchoring transverse column 52 having a longitudinal axis coincident to the pivot axis A and a threaded pivot axis bolt 54 (obscured from view, see FIG. 5) anchored thereto aligning with the pivot axis A, a rotatable handle 56 that threadedly engages the threaded pivot axis bolt 54. The head 36 of the center column 34 has a head bore 58 (obscured from view, identified by phantom lines designating location) through which the threaded pivot axis bolt 54 passes. The threaded pivot axis bolt 54 also passes through the receiving disk 46 so that head 36 may be snugly nested within the elongate recess 44 between the rotatable handle 56 and receiving disk 46. By advancing threadedly the rotatable handle 56 against head 36, head 36 is forced against the receiving disk 46 within the elongate recess 44 to capture and secure head 36 within the elongate recess 44 and clamps the receiving disk 46 against anchoring transverse column 52. In this manner the support assembly 14 and the receiving disk 46 portion of the pivot adjustment assembly 42 is tightened and secured to the anchoring transverse column 52.

To enhance securement and prevent tilt slippage during operation between the receiving disk 46 and the anchoring transverse column 52, additional features may be employed. For example, the receiving disk 46 may have a first meshing teeth interface 60 and the anchoring transverse column 52 may have a second meshing teeth interface 62, the teeth interfaces mesh to prevent tilting rotation of the receiving disk 46 relative to the anchoring transverse column 52, and to reduce frictional wear on the teeth, a resilient compression pad 64 may be disposed between the meshing teeth interfaces 60, 62. FIG. 3 depicts an enlarged overhead view of the pivot adjustment assembly 42 showing first meshing teeth interface 60 and second meshing teeth interface 62 separated by the resilient compression pad 64.

By retracting threadedly the rotatable handle 56 from head 36, the pivot adjustment assembly 42 may be loosened sufficiently to permit anchoring transverse column 52 to rotate relative to receiving disk 46 without releasing head 36 from within its nesting disposition with elongate recess 44. In this manner, the anchoring transverse column 52 may rotate to allow the ball propelling machine 20 to freely tilt rotationally about pivot axis A. A desired tilt of the ball propelling machine 20 may be secured by tilting the ball propelling machine 20 to the desired tilt and then tightening the pivot adjustment assembly 42 to clamp the receiving disk 46 in meshed engagement with the anchoring transverse column 52.

Figure 2:
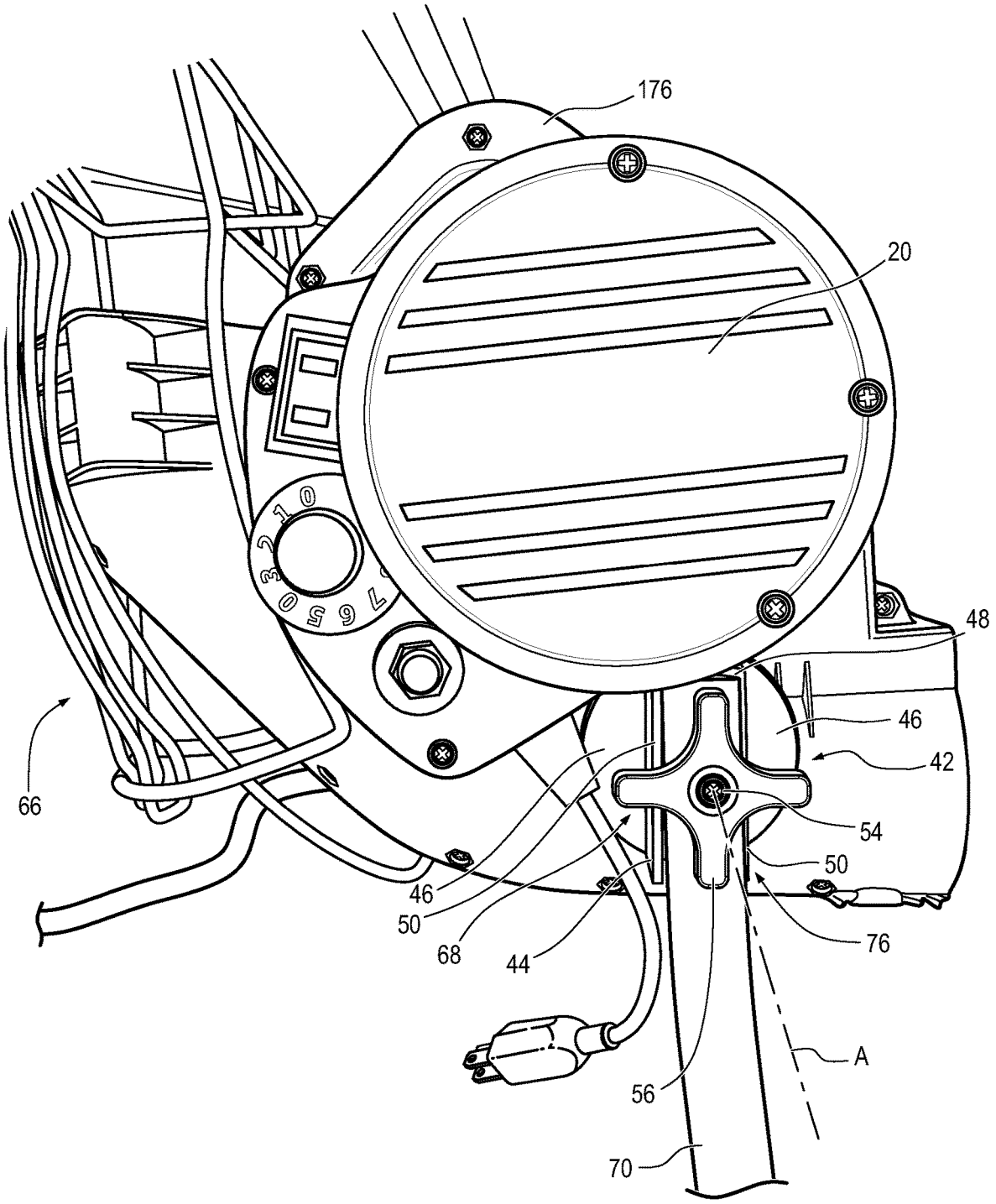
FIG. 2 is a close-up partial side view of the ball propelling machine of FIG. 1C showing connections to the netting structure and an exemplary ball-chute harness.

FIG. 2 is a close-up partial side view of the ball propelling machine 20 of FIG. 1C showing the ball propelling machine 20 in the pitchback mode 16 as connected to the netting structure 18 and an exemplary ball-chute harness 66. Connecting the ball propelling machine 20 to the netting structure 18 is quite similar to connecting the ball propelling machine 20 to the center column 34 of the support assembly 14. An exemplary mounting assembly 68 secures an exemplary mounting pedestal 70 to nest within the elongate recess 44. The mounting assembly 68 comprises the receiving disk 46 with the elongate recess 44 having a ceiling wall 48 and parallel side walls 50, the anchoring transverse column 52 having a longitudinal axis coincident to the pivot axis A and a threaded pivot axis bolt 54 (obscured from view, see FIG. 5) anchored thereto aligning with the pivot axis A, the rotatable handle 56 that threadedly engages the threaded pivot axis bolt 54.

When the combination pitching/pitchback machine 10 is in the pitching mode 12, the ball propelling machine 20 is connected to the support assembly 14 wherein the head 36 of the center column 34 has a head bore 58 through which the threaded pivot axis bolt 54 passes. In contrast, when the combination pitching/pitchback machine 10 is in the pitchback mode 16, the ball propelling machine 20 is connected to the netting structure 18 wherein the mounting pedestal 70 also has a pedestal bore 72 (obscured from view, identified by phantom lines designating location) through which the threaded pivot axis bolt 54 passes. Further, the threaded pivot axis bolt 54 also passes through the receiving disk 46 so that mounting pedestal 70 may be snugly nested within the elongate recess 44 between the rotatable handle 56 and receiving disk 46. By advancing threadedly the rotatable handle 56 against mounting pedestal 70, mounting pedestal 70 is forced against the receiving disk 46 within the elongate recess 44 to capture and secure mounting pedestal 70 within the elongate recess 44 and clamps the receiving disk 46 against anchoring transverse column 52. In this manner the mounting pedestal 70 of the netting structure 18 and the receiving disk 46 portion of the pivot adjustment assembly 42 is tightened and secured to the anchoring transverse column 52.

Hence, the mounting assembly 68 lacks the head bore 58 in head 36 of the center column 34, while the pivot adjustment assembly 42 lacks the pedestal bore 72 in the mounting pedestal 70. For purposes of this disclosure, the head 36 with head bore 58 of the center column 34 shall collectively be an exemplary embodiment within the definition of a connection assembly 74 for connecting the support assembly 14 to the mounting assembly 68, and the mounting pedestal 70 with pedestal bore 72 shall collectively be an exemplary embodiment within the definition of a connecting assembly 76 for connecting the support assembly 14 to the mounting assembly 68. Further, for purposes of this disclosure the scope of mounting assembly 68 should not be limited to the exemplary embodiment disclosed herein because any suitable connection of the ball propelling machine 20 to another structure should be considered within the scope and meaning of mounting assembly 68, including any assembly of component parts of that connect the ball propelling machine 20 to another structured that travel with the ball propelling machine 20 during transit between modes of operation also should be considered within the scope and meaning of mounting assembly 68.

Figure 4:
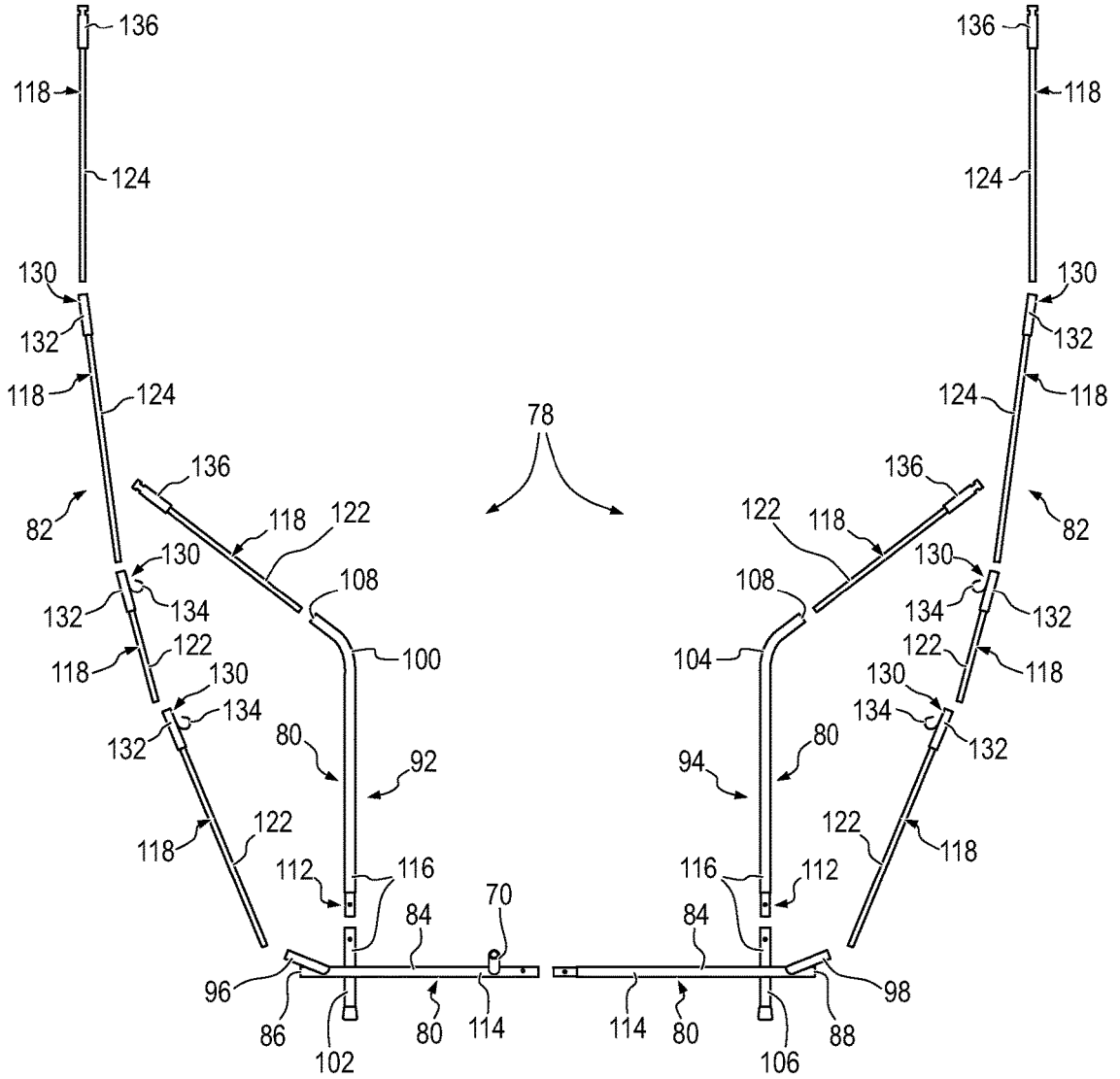
FIG. 4 is an exploded view of an exemplary embodiment of a framework assembly for the netting structure showing the various components in an exploded configuration to assist with assembly.
Figure 5:
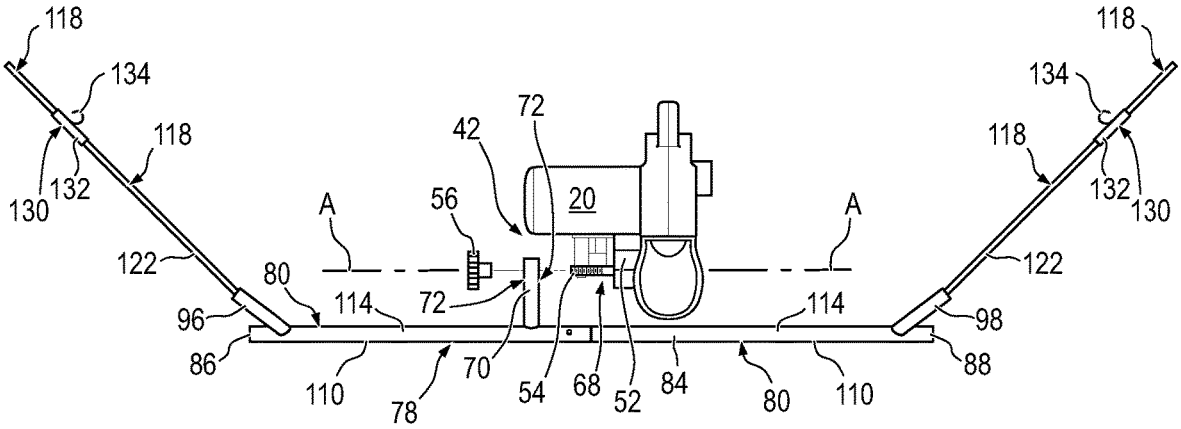
FIG. 5 is a frontal view a partially assembled portion of an exemplary embodiment of framework assembly with an exemplary dual-purpose ball propelling machine exploded from connection to the framework assembly to better illustrate assembling the connection.

Turning now to FIGS. 4 and 5 exemplary embodiments of a framework assembly 78 are depicted. FIG. 4 is an exploded view of an exemplary embodiment of framework assembly 78 for the netting structure 18 showing the various components in an exploded configuration to assist with assembly. When assembled as suggested by the exploded depiction in FIG. 4 the assembly will form an exemplary framework assembly 78 to which netting may be attached. FIG. 5 is a frontal view of a partially assembled portion of an exemplary embodiment of framework assembly 78 with an exemplary ball propelling machine 20 exploded from connection to the framework assembly 78 to better illustrate assembling the connection. The framework assembly 78 has a base assembly 80 and a net anchoring assembly 82, the base assembly 80 may be positioned to rest on the supporting surface 24 (such as the ground, a concrete pad, etc.) while supporting the connected net anchoring assembly 82 above the supporting surface 24.

An exemplary base assembly 80 has a cross bar 84 with a first end 86 and a second end 88 disposed at opposite ends of the cross bar 84, a first transverse foot 92, a second transverse foot 94, a first upturned pole receptacle 96, and a second upturned pole receptacle 98. The transverse feet 92, 94 may be disposed transverse to the cross bar 84 (meaning disposed across the cross bar, including angled or orthogonally) with each transverse foot 92, 94 connecting to the cross bar 84 proximate to one of the opposing ends (first end 86 and second end 88).

The first transverse foot 92 has a first upturned heal portion 100 and a first toe portion 102 and the second transverse foot 92 has a second upturned heal portion 104 and a second toe portion 106, and each upturned heal portion 100, 104 may have a pole receiving end 108.

The transverse feet 92, 94 are instrumental in creating anti-teeter-tottering situations because, in some embodiments the interplay in the connection of the transverse feet 92, 94 to the cross bar 84 determines if the cross bar 84 is supported above the supporting surface 24 (i.e., the underside 110 of the cross bar 84 is disposed above the supporting surface 24). This small elevation of the cross bar 84 avoids most situations where an uneven supporting surface 24 may have high points that may become a fulcrum that turns the cross bar 84 into a teeter-totter.

Figure 8:
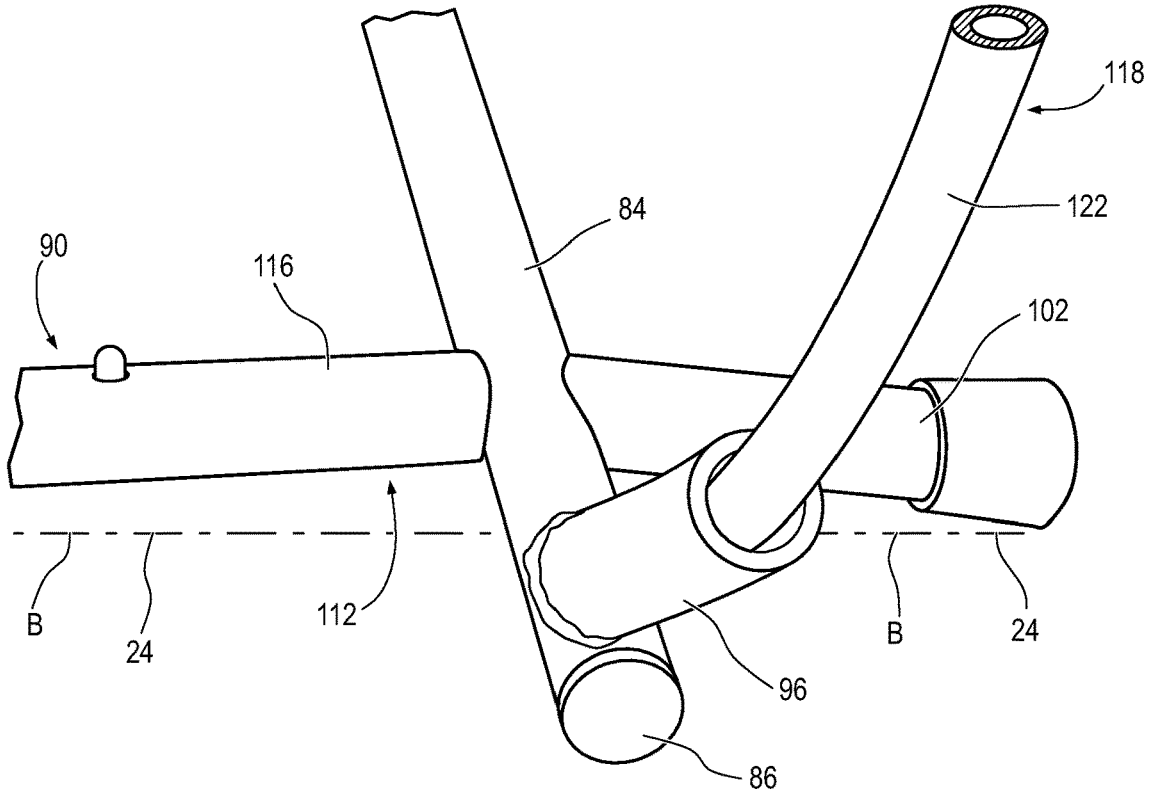
FIG. 8 is a cut-away perspective view of an exemplary embodiment of a portion of the framework assembly showing a truncated flexible pole flexed and nesting within an upturned pole receptacle.

In some exemplary embodiments, the upturned heal portions 100, 104 and the toe portions 102, 106 of each transverse foot 92, 94 are configured so that each will contact the supporting surface 24 when positioned to rest upon a flat supporting surface 24 and that the underside 110 of the cross bar 84 is disposed above the supporting surface 24. One such configuration, for example, has the transverse feet 92, 94 subtending the cross bar where they connect with the cross bar 84 and the transverse feet 92, 94 are flat heal to toe, as depicted in FIG. 4. Another exemplary configuration, best shown in FIG. 8, has the first transverse foot 92 inclined from the first upturned heal portion 100 to the cross bar 84 and also inclined from the first toe portion 102 to the cross bar 84, thereby forming an arch portion 112 of the first transverse foot 92 and has the second transverse foot 94 likewise inclined from the second upturned heal portion 104 to the cross bar 84 and the second toe portion 106 likewise inclined to the cross bar 84, thereby forming a corresponding arch portion 112 of the second transverse foot 94. With this configuration placed on a flat supporting surface 24 only the upturned heal portions 100, 104 and the toe portions 102, 106 contact the flat supporting surface 24 because the arch portions 112 will be spaced from the flat supporting surface 24, as depicted in FIG. 8 by dashed line B that represents a line along the flat supporting surface 24. Consequently, it is less likely that any high points in an uneven supporting surface 24 will become a fulcrum to turn the transverse feet 92, 94 into a teeter-totter, and if there is such a high point fulcrum, slight shifting of the base assembly 80 forward, back or from one side to another location will avoid instability, thereby creating 4-point stability for the base assembly 80.

In the pitchback mode, the base assembly 80 further comprises the mounting pedestal 70 upon which the ball propelling machine 20 is mounted by securing the mounting pedestal 80 to the mounting assembly 78, as discussed above. To center the ball propelling machine 20, which may have a vertical tilting range upward and downward from horizontal, to propel balls 22 along the vertical center of the framework assembly 78, the mounting pedestal 70 is offset from the center of the framework assembly 78. With the ball propelling machine 20 secured to the mounting pedestal 70, the launch point of the propelled balls 22 will be above the cross bar 84 that may already be elevated above the supporting surface 24, the height of that launch point elevation will determine the practical limit for tilting the ball propelling machine 20 from propelling grounders, high hop grounders, worm burners (hard hit grounders that skid along close to the ground). Without tilting the ball propelling machine 20 upward that launch point is low enough that propelled ball will likely bounce before it reaches the player throwing the ball into the netting. Hence, in most pitchback instances the ball propelling machine will be tilted upward so that the ball is returned to the thrower within the reasonable catch radius without causing the thrower to move or jump, or to have the pitchback to simulate a line drive, a blooper, a pop-up, or a fly ball. For this reason, it is preferred that the ball propelling machine 20 have vertical tilting capability, though not absolutely required, because the mounting pedestal 70 may be angled to provide upward ball trajectory that returns the ball 22 to the thrower at a standard reasonable catch radius, thereby compensating for a ball propelling machine 20 that launches the ball 22 horizontally while in the pitching mode 12.

Further, the base assembly 80, in some exemplary embodiments (see FIGS. 4 and 5), may be modular in that the cross bar 84 may comprise two or more cross bar sections 114 that may be secured to each other to form the cross bar 84. If there are only two equal length cross bar sections 114, the mounting pedestal 70 will be connected to just one section 114 offset from the joint connection of the two cross bar sections 114. Additionally, the transverse feet 92, 94 may also be modular, divided into feet sections 116. Such modularity typically is advantageous to packaging and shipping.

The base assembly 80 has a low profile (again advantageous for packaging and shipping) that supports the net anchoring assembly 82 above the supporting surface 24. The net anchoring assembly 82 includes a plurality of poles 118 that may be assembled to provide the structure for attaching a netting 120 and maintain the contours and shape designed into the netting 120. The plurality of poles 118 includes foundation poles 122 and extension poles 124. The foundation poles 122 and the extension poles 124 may be the same or different, for example, they may be made of the same material or a differing material, have the same diameters or a differing diameter, the same thickness or a differing thickness, the same weight density or a differing weight density, the same flexibility or a differing flexibility, and/or the same resiliency or a differing resiliency. In short, the foundation poles 122 and the extension poles 124 may have the same physical characteristics pertinent to structural poles 118 of this type or different physical characteristics.

In one exemplary embodiment, the foundation poles 122 and/or the extension poles 124 may be made of the same materials and have the same physical characteristics as the base assembly 80. In another exemplary embodiment, the base assembly 80 may be made of aluminum or a lightweight steel while the foundation poles 122 and/or the extension poles 124 may be made of fiberglass or another fiber-reinforced polymer. Yet another exemplary embodiment may have the foundation poles 122 be thicker, heavier, and/or less flexible and the extension poles 124 be thinner, lighter and/or more flexible. Those skilled in the art armed with this disclosure, will understand the range of flexibility there is in determining what physical characteristics the base assembly 80, the foundation poles 122, and the extension poles 124 may exhibit and how they interplay with each other to fine tune resulting effects on the netting structure 18, the framework assembly 78, and the pitchback assembly 126 (the netting structure 118 plus a netting assembly 128 as attached) as shown in FIGS. 1 and 6.

In some exemplary embodiments, foundation poles 122 will be seated into and rest within the pole receiving ends 108 of the upturned heal portions 100, 104 of the base assembly 80 and the upturned pole receptacles 96, 98 of the base assembly 80. These foundation poles 122 may be foundational in defining the contours and design of the netting assembly 128.

As shown in FIG. 4, each of the plurality of poles 118 have pole connection features 130, these pole connection features 130 may comprise any suitable feature that connects one pole 118 to another end to end or connect a pole 118 to another structure, those depicted in the drawings are exemplary and should not be limiting. FIG. 4 shows pole connecting sleeves 132 and pole connecting sleeves 132 with hooks 134 that connect poles 118 end to end, as well as anchoring end caps 136 that connect poles 118 to other structures such as netting attachment features 138 to be discussed below in more detail.

Figure 6:
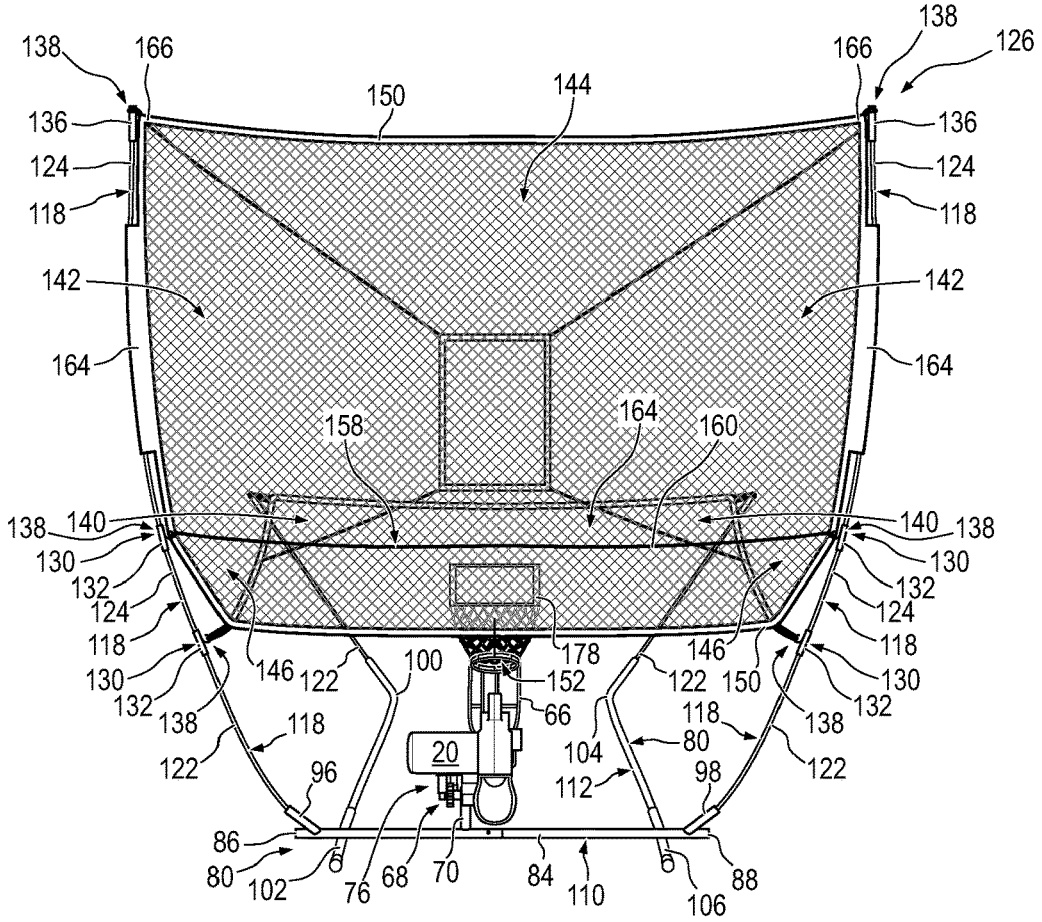
FIG. 6 is a perspective view of an exemplary embodiment of a dual-purpose ball propelling machine connected to the netting structure depicting an exemplary pitchback mode configuration.

FIG. 6 is a perspective view of an exemplary embodiment of the combination pitching/pitchback machine 10 connected to the netting structure 18 with a netting assembly 128 to depict an exemplary pitchback assembly 126 in a pitchback mode 16 configuration.

Figure 10:
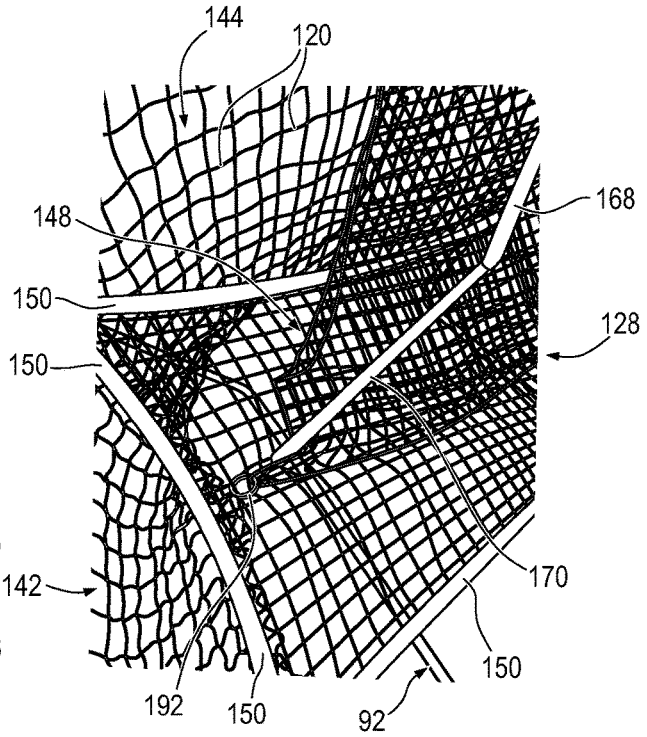
FIG. 10 is a perspective cut-away view of an exemplary embodiment of a portion of the pitchback assembly showing a ring anchor for connecting and positioning a target square assembly and an exemplary shock-absorbing netting flap.
Figure 11:
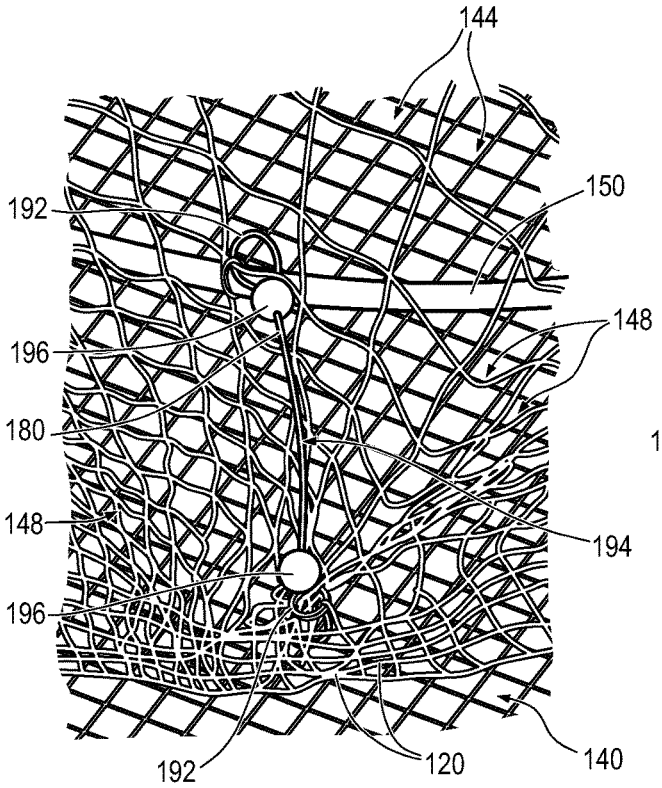
FIG. 11 is a perspective view of a portion of the exemplary netting assembly depicting an exemplary netting flap inhibitor.

An exemplary embodiment of the netting assembly 128 has a netting floor 140, netting side panels 142, a netting rear panel 144, a netting front panel 146, a shock-absorbing netting flap 148, peripheral netting edge ribbons 150, and the netting attachment features 138 of various types. The shock-absorbing netting flap 148 is not shown in FIG. 6 so not to obscure other netting features (shock-absorbing netting flap 148 is shown in FIGS. 1, 10 and 11). The netting floor 140 generally has a rectangular footprint with netting attachment features 138 secured to each corner and peripheral netting edge ribbons may be threaded with elastic cords. The foundation poles 122 seated within the upturned pole receptacles 96, 98 of the base assembly 80 may each have a pole connecting sleeve 132 with a hook 134 to which a netting attachment feature 138 may be releasably secured. The foundation poles 122 seated within the pole receiving ends 108 of the upturned heal portions 100, 104 of the base assembly 80 (together with the foundation poles 122 seated within the upturned pole receptacles 96, 98 are considered foundational poles and may be referred to herein collectively as first level foundational poles) may have anchoring end caps 136 to which a netting attachment feature 138 may be releasably secured. The netting floor 140 may have a throat opening 152 secured with a tension assembly 154 that is attached or attachable to the ball-chute harness 66. The tension assembly 154 assists in creating and maintaining a funnel-shaped contour for the netting floor 140 by applying the proper tension between the netting floor's 140 peripheral netting edge ribbons 150 and the tension assembly 154 at the throat opening 152 and adding the weight of the ball-chute harness 66 when attached.

The netting side panels 142, netting rear panel 144, and netting front panel 146 each have peripheral netting edge ribbons 150 and are connected to the netting floor 140. Where the netting floor 140 lays generally horizontal directionally, the netting side panels 142, a netting rear panel 144, a netting front panel 146 each drape vertical directionally and together they generally form a pouch 156 with the back extending higher than the front.

Either a pair of foundation poles 122 or a pair extension poles 124 may be positioned to extend upward and seated within the pole connecting sleeves 132 with hooks 134, thereby connecting the pair of foundation poles 122 or the pair extension poles 124 to the pair of foundation poles 122 securing the netting floor 140 and having the pole connecting sleeves 132 with hooks 134. The selection of whether the pair of foundation poles 122 or the pair extension poles 124 matters only if they differ in physical characteristics that matter to the operation of the structure; for example, and not to be limiting, more heavy duty foundation poles 122 may be desired for professional, college, or high school use and a lighter duty more flexible extension poles may be desired for youth, indoor only use, or mass market sales.

Each pole 118 of the selected pair of foundation poles 122 or pair of extension poles 124 may have pole connecting sleeves 132 with hooks 134 and may be referred to herein collectively as second level framework poles 118. The netting assembly 128 has a pair of side/front junctures 158 where the netting front panel 146 connects to the netting side panels 142 and netting attachment features 138 are located. The netting attachment features 138 located at the side/front junctures 158 may be secured to the pole connecting sleeves 132 with hooks 134 to place tension on the upper edge 160 of the netting front panel 146, thereby assisting in keeping the netting front panel 146 generally vertical to form a cupping structure 162 to keep thrown balls 22 within the confines of the cupping structure 162 and funnel the balls 22 to the throat opening 152.

One or more pairs of extension poles 124 may be connected, directly or indirectly, to the pole connecting sleeves 132 with hooks 134 of the second level framework poles. These pairs of extension poles 124 determine the ultimate height of the netting structure 18. If only one pair of extension poles 124 is used as in one exemplary embodiment of the pitchback assembly 126, the length may be limited by packaging and shipping considerations and physical characteristics like strength and flexibility may be considerations. In the exemplary embodiment depicted in FIG. 6, two pairs of extension poles 122 are shown, the lowermost pair of extension poles 122 may be secured directly to and seated within the pole connecting sleeves 132 with hooks 134 of the second level framework poles. This lowermost pair extension poles 132 may have a pole connection sleeve 132 into which another extension pole 122 is secured and seated. The uppermost pair of extension poles 122 has an anchoring end cap 136 and seats directly into the pole connection sleeve 132. To extend tensioned support for the netting side panels 142, each netting side panel 142 has a pass-through sleeve 164 connected to the peripheral netting edge ribbon 150 along the forward edge of the netting side panel 142. The uppermost corners 166 of the netting assembly 128 have netting attachment features 138 that may be attached to the anchoring end caps 136 of the uppermost pairs of extension poles 122.

The tension applied to the netting 120 by the attachment of the netting 120 to the net anchoring assembly 82 is relatively slack except for the tension applied to establish and maintain the funnel-like contour of the netting floor 140. Such relatively slack netting serves to absorb more energy of the thrown balls 22, causing the balls to drop onto the netting floor 140 rather than bounce off of more tightly tensioned draping netting 120, possibly bouncing out of the pitchback assembly 126 completely missing the pouch 156. Further, the shock-absorbing netting flap 148 drapes loosely or is loosely tethered having only draping tension of gravity acting on the netting flap 148 so to absorb as much energy of the thrown ball 22 as possible. Balls 22 impacting the loosely draping shock-absorbing netting flap 148, do not bounce, but drop to the netting floor 140 within the pouch 156 designed to capture and funnel balls 22 to the ball-chute harness 66 for delivery to the ball propelling machine 20 for pitchback to the thrower.

Some exemplary embodiments also have a target square 168. The target square 168 depicted in FIG. 6 is removably tethered to the netting assembly 128 forward of the netting rear panel 144 and the shock-absorbing netting flap 148 using target square straps 170. Such target square straps 170 are length adjustable so that the height and centering of the target square 168 may be adjusted.

Figure 7A:
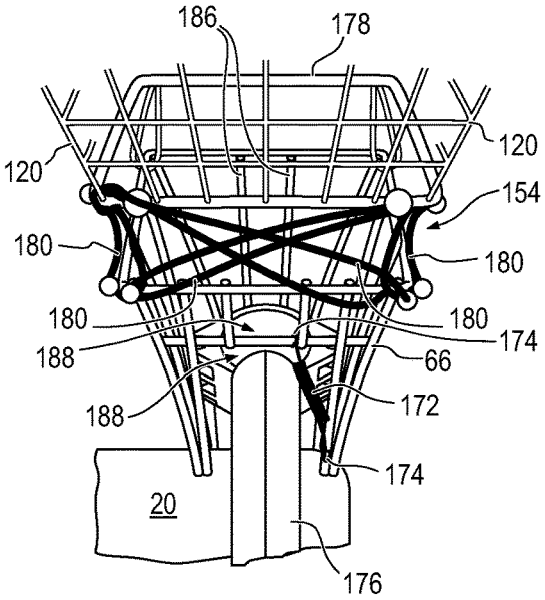
FIGS. 7A-E are a series of perspective views depicting the positioning and securing of the dual-purpose ball propelling machine to an exemplary embodiment of a ball-chute harness non-rigidly.
Figure 7B:
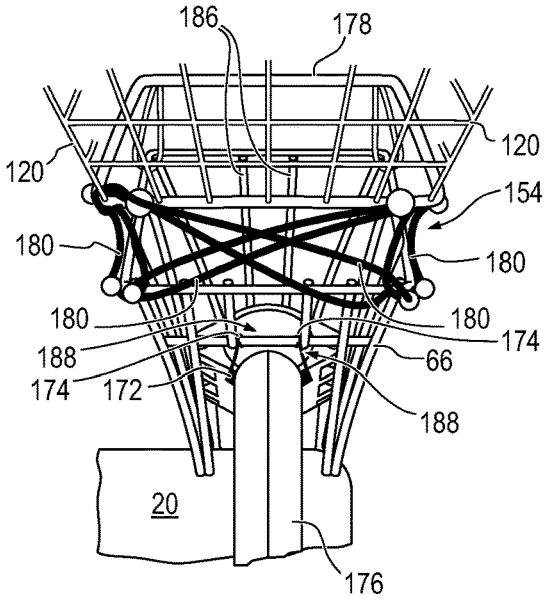
Figure 7C:
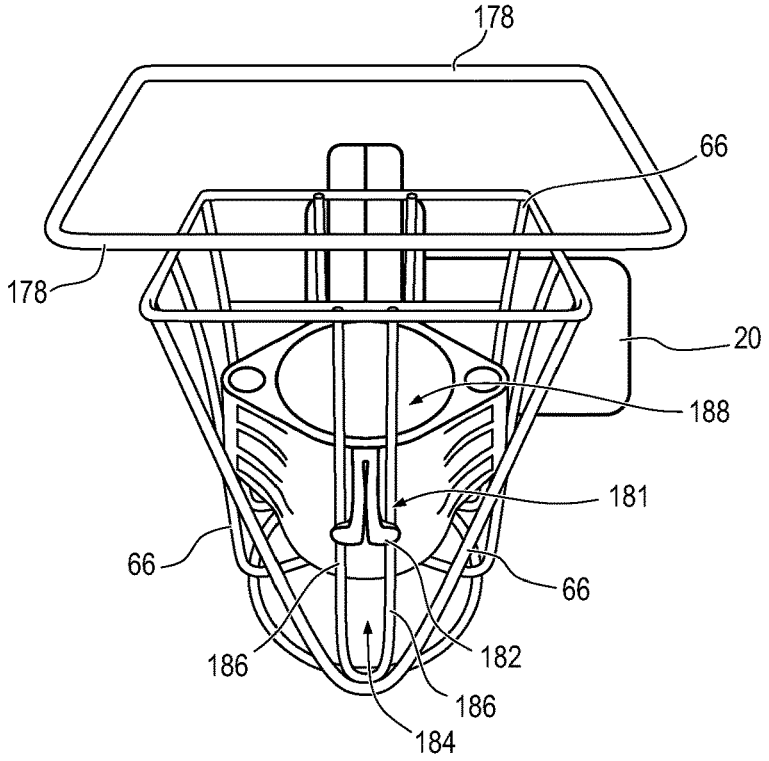
Figure 7D:
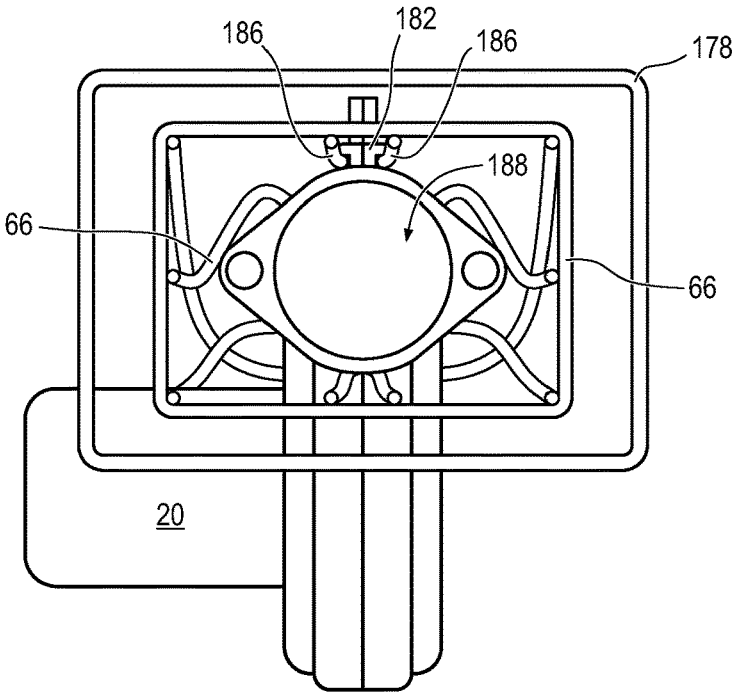
Figure 7E:
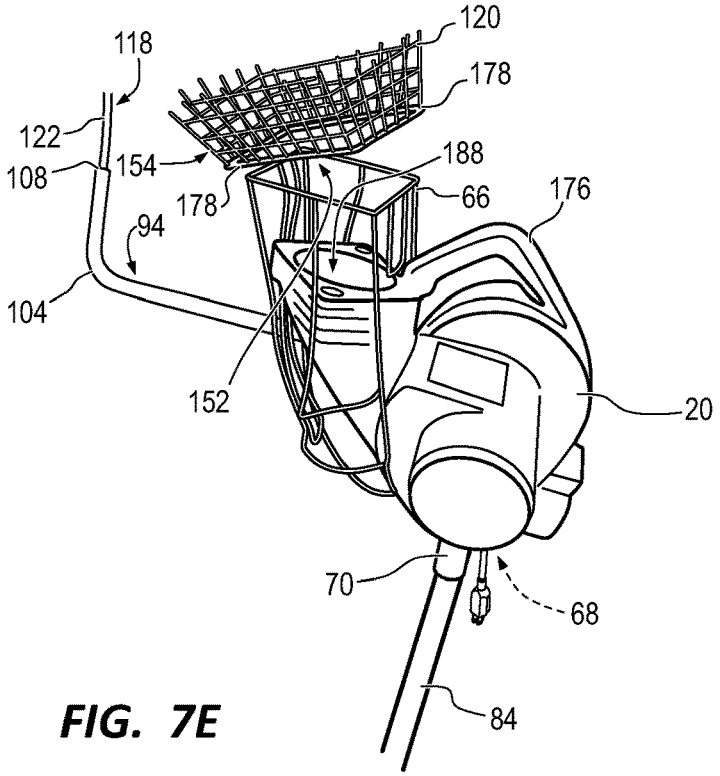

FIGS. 7A-E are a series of perspective views depicting the positioning and securing of the ball propelling machine 20 to an exemplary embodiment of a ball-chute harness 66 non-rigidly. FIG. 7A depicts the securing of the ball propelling machine 20 to the ball-chute harness 66 non-rigidly by using a spring 172 with one hook end 174 connected to the ball-chute harness 66, while FIG. 7B depicts the spring 172 looping around a handle 176 of the ball propelling machine 20 and both hook ends 174 connected to the ball-chute harness 66, thereby capturing the ball-chute harness 66 in a somewhat resilient connection, allowing some movement and flexibility to the ball-chute harness 66 attachment, but not detachment. FIG. 7C is a rearward perspective view of the ball-chute harness 66 positioned and connected to the ball propelling machine 20, while FIG. 7D is a top view of the ball-chute harness 66 positioned and connected to the ball propelling machine 20. FIG. 7E is a perspective view of an exemplary staging of the ball-chute harness 66 as connected to the ball propelling machine 20 staged for connection to an exemplary embodiment of a netting harness 178 that defines the throat opening 152 of the netting assembly 128 to the ball-chute harness 66.

FIGS. 7A and 7B illustrate the non-rigid connection of the ball-chute harness 66 to the netting harness 178 utilizing elastic cords 180 interlaced about and between the netting harness 178 and the upper portion of the ball-chute harness 66 while the spring 172 is wrapped around the handle 176 of the ball propelling machine 20 and the hook ends 174 of spring 172 grasp the ball-chute harness 66. The elastic cords 180 and the spring 172 provide a degree of resiliency to the non-rigid connection, enabling an otherwise rigid ball-chute harness 66 to be positioned and connected securely.

FIGS. 7C and 7D depict the netting harness 178 (without netting 120 attached) suspended untethered above the ball-chute harness 66 as connected to the ball propelling machine 20 to demonstrate how the non-rigid connection will permit some twisting and lateral movement of the netting harness 178 without appreciable movement of the ball-chute harness 66. A backside sliding connection 181 of the ball-chute harness 66 to the ball propelling machine 20, as depicted in FIG. 7D, is also a non-rigid connection permitting limited jostling, twisting, and bouncing movement without disengaging the backside sliding connection 181. The components utilized to create the backside sliding connection 181 may comprise, for example, a T-flange 182 and a slot structure 184. The T-flange 182 protrudes from the backside of the ball propelling machine 20 and acts much like a T-bolt and slot. The slot structure 184 may comprise parallel harness bars 186 spaced closely enough from each other that the T-flange 182 will capture parallel harness bars 186 in slidable engagement.

FIG. 7E depicts the ball-chute harness 66 as connected to the ball propelling machine 20 being staged for connection to the netting harness 178. The alignment of the throat opening 152 and netting harness 178 of netting assembly 128 to the ball-chute harness 66 facilitates the non-rigid connection to provide a pathway for thrown balls 22 to gather onto the netting floor 140, funnel through the throat opening 152 into a ball chute 188 of the ball propelling machine 20 to be propelled back towards the thrower.

FIG. 8 illustrates a portion of the framework assembly 78 showing a truncated flexible pole 118 flexed and nesting within an upturned pole receptacle 96, 98 in an exemplary configuration in which an arch portion 112 is shown to be elevated above dashed line B that represents a line along the flat supporting surface 24.

Figure 9:
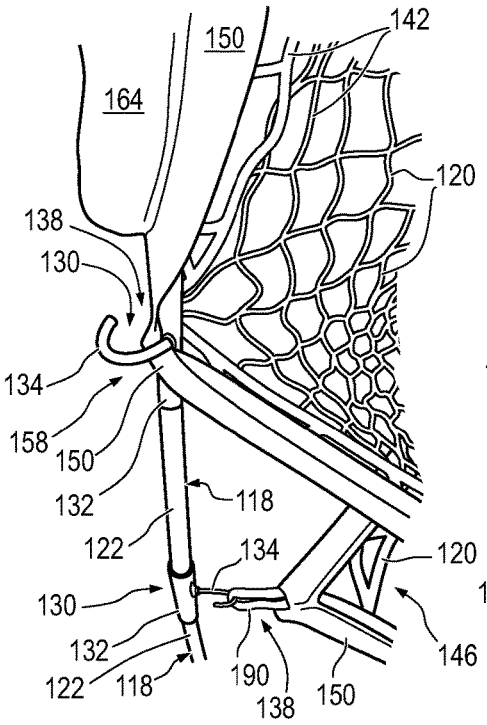
FIG. 9 is a cut-away perspective view of an exemplary embodiment of a portion of the netting structure showing an exemplary netting assembly being captured and stretched for assembly as part of the pitchback assembly.

Two representative examples of netting attachment feature 138 are depicted in FIG. 9, a cut-away perspective view of an exemplary embodiment of a portion of the netting structure 18 showing an exemplary netting assembly 128 being captured and tensioned for assembly as part of the pitchback assembly 126. The lowermost netting attachment feature 138 comprises a loop tab 190 secured to the hook 134 of the pole connecting sleeve 132 connecting poles 118 end to end. The loop tab 190 of the lowermost netting attachment feature 138 is secured to a front corner of the netting floor 140. When all four corners of the netting floor 140 are secured by netting attachment features 138, a tension is applied to the netting 120 that maintains the netting floor's 140 funneling contour when connected to the ball-chute harness 66.

The uppermost netting attachment feature 138 is also a hook 134 of a pole connecting sleeve 132 connecting poles 118 end to end at the front of the netting side panel 142. In this case, the depiction shows another exemplary netting attachment feature 138 wherein the hook 134 captures and secures a portion of the peripheral netting edge ribbon 150 and/or a portion of the netting 120. Although this attachment may apply tension to the netting 120 that affects the netting side panel 142 contour and widens the width of the overall pitchback assembly 126, the netting side panel is not intended to be taut. As discussed above, the netting side panels 142 drape somewhat loosely to avoid having thrown balls 22 bounce out of the pouch 156 onto the ground, rather than dropping to the netting floor 140 to be funneled to the ball propelling machine 120.

A portion of a pass-through sleeve 164, another example of a netting attachment feature 138, is depicted in FIG. 9, however, the support for the netting side panels 142 provided by the pass-through sleeves 164 is described above with reference to other figures that better illustrate and describe the pass-through sleeve 164.

FIG. 10 is a perspective cut-away view of an exemplary embodiment of a portion of the pitchback assembly 126 showing one of a pair of ring anchors 192 secured by netting 120 in the netting floor panel 140 for connecting and positioning the target square straps 170 to suspend the target square 168 as desired and also to loosely tether the shock-absorbing netting flap 148 for optimum shock absorbing and to assure that the shock-absorbing netting flap 148 remains draped between the target square 168 and the netting rear panel 144 and does not get tangled in the target square 168 and its target square straps 170 and does not move over the top of the pitchback assembly 126 to drape behind the netting rear panel 144.

Another feature to prevent the shock-absorbing netting flap 148 from draping behind the netting rear panel 144 is depicted in FIG. 11. This feature is an exemplary netting flap inhibitor 194 has ring anchors 192, one secured to a lower portion of netting 120 in the netting rear panel 144 and the other secured to a lower portion of netting 120 of the shock-absorbing netting flap 148. The netting flap inhibitor 194 also has a short elastic cord 180 with anti-snag balls 196 on each end thereof. Each end of the elastic cord 180 connects to one of the ring anchors 192. The netting flap inhibitor 194 is designed not to snag or tear the netting 120 and to also prevent entangling with the target square 168 or target square straps 170.

Figure 12:
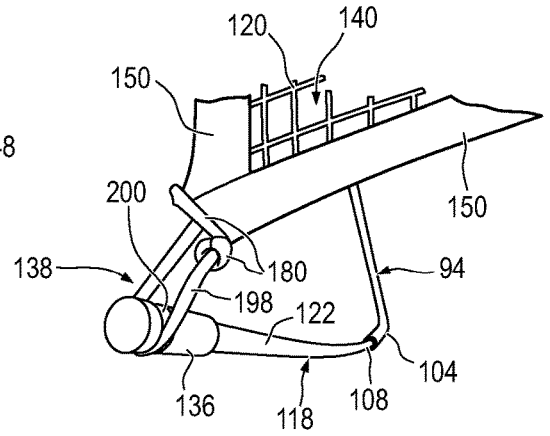
FIG. 12 is a perspective view of portion of an exemplary netting floor as connected to a foundation pole nesting within a pole receiving end of an upturned heal portion of a transverse foot.

FIG. 12 depicts another exemplary netting attachment feature 138. The depiction shows a perspective view of an exemplary portion of the netting floor 140 including a rear corner with a looped cord 198 connected to a foundation pole 122 nesting within a pole receiving end 108 of an upturned heal portion 104 of transverse foot 94. The anchoring end cap 136 atop the foundation pole 122 captures the looped cord 198 (which differs from the loop tab 190) within circular groove 200 in the anchoring end cap 136 and the captured connection provides tension to the netting floor 140 as discussed above. Also depicted is an elastic cord 180 shown as tied off around the looped cord 198. The remainder of the elastic cord 180 which is not visible is threaded through the peripheral netting edge ribbon 150 and tied off outside of the depiction. Various peripheral netting edge ribbons 150 have elastic cords 180 threaded therethrough to provide additional resilient form-maintaining support and tension for the netting 120.

Those skilled in the art will appreciate that the present embodiments are exemplary and representative and should not be limited to the embodiments shown and described. The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A ball propelling apparatus positioned to rest on a supporting surface, comprising:

a ball propelling machine having a mounting assembly; and a netting structure comprising a framework assembly and a ball-chute harness, the framework assembly having a connecting assembly for connecting to the mounting assembly and the ball-chute harness for connecting to the ball propelling machine, framework assembly comprises a base assembly and a net anchoring assembly, the base assembly for positioning to contact the supporting surface, the net anchoring assembly connected to the base assembly, the base assembly comprises a cross bar having a first end and a second end, a first transverse foot, a second transverse foot, a first upturned pole receptacle, and a second upturned pole receptacle, the first upturned pole receptacle being connected to the crossbar at the first end and the first transverse foot being connected to the cross bar proximate to the first end, the second upturned pole receptacle being connected to the crossbar at the second end and the second transverse foot being connected to the cross bar proximate to the second end.

2. The ball propelling apparatus of claim 1 wherein the first transverse foot has a first upturned heal portion and a first toe portion and the second transverse foot has a second upturned heal portion and a second toe portion, and wherein the first upturned heal portion and the second upturned heal portion have a pole receiving end.

3. The ball propelling apparatus of claim 1 wherein the first transverse foot and the second transverse foot support the cross bar such that an underside of the cross bar is disposed above the supporting surface.

4. The ball propelling apparatus of claim 2 wherein the first upturned heal portion, the first toe portion, the second upturned heal portion, and the second toe portion will each contact the supporting surface when positioned to rest upon a flat supporting surface and that an underside of the cross bar is disposed above the supporting surface.

5. The ball propelling apparatus of claim 4 wherein the first transverse foot is inclined from the first upturned heal portion to the cross bar and is inclined from the first toe portion to the cross bar, thereby forming a first arch portion of the first transverse foot, and the second transverse foot is inclined from the second upturned heal portion to the cross bar and is inclined from the second toe portion to the cross bar, thereby forming a second arch portion of the second transverse foot.

6. The ball propelling apparatus of claim 5 wherein only the first upturned heal portion, the first toe portion, the second upturned heal portion, and the second toe portion of the base assembly contact the supporting surface when the base assembly is positioned to rest upon a flat supporting surface, thereby creating four-point stability for the base assembly while the underside of the cross bar is disposed above the supporting surface.

7. The ball propelling apparatus of claim 1 wherein the base assembly further comprises a mounting pedestal offset from a center of the cross bar, the center being equidistant from the first end and the second end, the mounting pedestal comprising an upright column connected to the cross bar and the connecting assembly for connecting to the mounting assembly.

8. The ball propelling apparatus of claim 1 wherein the base assembly is modular, and the cross bar comprises a first cross bar section and a second cross bar section wherein the first cross bar section connects to the second cross bar section.

9. The ball propelling apparatus of claim 1 wherein the base assembly is modular, and each of the first transverse foot and the second transverse foot comprise a first foot section and a second foot section.

10. The ball propelling apparatus of claim 1 wherein the net anchoring assembly further comprises a plurality of poles.

11. The ball propelling apparatus of claim 10 wherein one pole of the plurality of poles is received into a first upturned pole receptacle of the base assembly and another pole of the plurality of poles is received into a second upturned pole receptacle of the base assembly.

12. The ball propelling apparatus of claim 10 wherein the base assembly comprises a first transverse foot having a first upturned heal portion and a second transverse foot having a second upturned heal portion, the first upturned heal portion and the second upturned heal portion each having a pole receiving end, and wherein one pole of the plurality of poles is received into the pole receiving end of the first upturned heal portion and another pole of the plurality of poles is received into the pole receiving end of the second upturned heal portion.

13. The ball propelling apparatus of claim 10 wherein the plurality of poles comprises foundation poles and extension poles.

14. The ball propelling apparatus of claim 13 wherein the extension poles have greater than or equal flexibility to the foundation poles.

15. The ball propelling apparatus of claim 10 wherein netting is connected to the netting structure, the netting being connected to the net anchoring assembly, thereby forming a netting assembly.

* * * * *